United States Patent [19]

Faust

[11] 4,291,929

[45] Sep. 29, 1981

[54] GUIDING RECIPROCABLE DRAWERS OF PIECES OF FURNITURE OR THE LIKE

[75] Inventor: Karl-Volker Faust, Bielefeld, Fed. Rep. of Germany

[73] Assignee: Paul Hettich & Co., Kirchlengern, Fed. Rep. of Germany

[21] Appl. No.: 96,419

[22] Filed: Nov. 21, 1979

[30] Foreign Application Priority Data

Nov. 27, 1978 [DE] Fed. Rep. of Germany ..... 2851305

[51] Int. Cl.[3] ..... A47B 88/00; F16C 21/00

[52] U.S. Cl. ..... 312/341 R; 312/311; 312/350; 308/3.8

[58] Field of Search ..... 312/341 R, 341 NR, 350, 312/311; 308/3.8

[56] References Cited

U.S. PATENT DOCUMENTS

| | | | |
|---|---|---|---|
| 353,640 | 11/1886 | Nourse | 312/341 R |
| 2,698,214 | 12/1954 | Skamser | 312/350 |
| 2,827,353 | 3/1958 | Johnson | 312/341 R |
| 3,734,589 | 5/1973 | Morgan | 312/311 |
| 3,744,869 | 7/1973 | Anderson et al. | 312/350 |
| 3,768,883 | 10/1973 | Kauffman | 312/311 |
| 3,975,063 | 8/1976 | Mahotka et al. | 312/341 R |
| 4,043,625 | 8/1977 | Bleeker | 312/311 |
| 4,112,539 | 9/1978 | Hagen | 312/341 R |

FOREIGN PATENT DOCUMENTS

| | | | |
|---|---|---|---|
| 2809930 | 9/1979 | Fed. Rep. of Germany | 312/341 R |

*Primary Examiner*—Victor N. Sakran
*Attorney, Agent, or Firm*—Peter K. Kontler

[57] ABSTRACT

The side faces of a reciprocable drawer carry U-shaped rails whose flanges are outwardly adjacent to the flanges of complementary U-shaped rails which are adjustably secured to a stationary member of the piece of furniture in which the drawer is installed. The front ends of the rails are accessible when the drawer is moved to a partly or fully open position, and the front ends of the rails on the stationary member can be moved up or down by eccentric worm wheels which are mounted between the flanges of the complementary rails and engage the respective upper flanges. The worm wheels can be rotated by worms which are mounted in the complementary rails and mesh with the respective worm wheels. When a worm is rotated, the corresponding eccentrically mounted worm wheel effects an upward or downward movement of the front end of the corresponding complementary rail, and such rail causes the front end of the associated rail on the drawer to share its movement. The worm wheels are secured to the stationary member by screws whose shanks extend through elongated vertical slots of the corresponding complementary rails. Cages with rolling elements are interposed between the flanges of the rails on the drawer and the neighboring flanges of the rails on the stationary member.

15 Claims, 4 Drawing Figures

GUIDING RECIPROCABLE DRAWERS OF PIECES OF FURNITURE OR THE LIKE

BACKGROUND OF THE INVENTION

The present invention relates to devices for guiding reciprocable members, especially to devices which can be used to guide drawers or other movable members of pieces of furniture. More particularly, the invention relates to improvements in devices for guiding drawers or analogous reciprocable members by means of rails or like components.

A drawback of presently known devices of the above outlined character is that, once installed in a piece of furniture, they cannot be adjusted and do not allow for adjustment of the members which are guided thereby. This presents many problems, for example, when the position of a drawer in a fully assembled cabinet or the like necessitates minor or major adjustments so as to align the front side of the drawer with the front sides of other drawers, to change the level of a drawer and/or for other purposes. Thus, once the rails of conventional devices which guide drawers or the like are installed, their positions with respect to the drawers and/or stationary parts of pieces of furniture remain fixed.

OBJECTS AND SUMMARY OF THE INVENTION

An object of the invention is to provide a novel and improved device which can adequately guide a reciprocable drawer or the like and allows for convenient adjustment of the level and/or inclination of the reciprocable member.

Another object of the invention is to provide an adjustable device which is simple, compact and inexpensive, and which can be used with advantage in many types of furniture and/or for other purposes.

A further object of the invention is to provide a device which is normally concealed but can be reached for adjustment with little loss in time.

An additional object of the invention is to provide a device which can be manipulated, installed or adjusted by semiskilled or unskilled persons and by resorting to rudimentary tools.

Another object of the invention is to provide an adjustable device which, if desired or necessary, can be installed in existing pieces of furniture as a superior substitute for heretofore known devices.

Another object of the invention is to provide a device which allows for practically effortless reciprocation of drawers or the like and whose constituents can be mass-produced at a reasonable cost.

An ancillary object of the invention is to provide novel and improved means for changing the level of rails in devices which guide drawers or other reciprocable component parts of pieces of furniture or the like.

Another object of the invention is to provide a device which occupies little room in storage and/or in actual use, and which can be used to guide large, small, bulky, compact, heavy or lightweight components which are reciprocable with respect to stationary parts.

One feature of the invention resides in the provision of a device for guiding a reciprocable member along an elongated path with respect to a second member, particularly for guiding a drawer with respect to a stationary component of a piece of furniture. The improved device comprises an elongated rail extending in substantial parallelism with the aforementioned path (i.e., in parallelism with the direction of movement of the reciprocable member) and being adjustably connected with the second member, an eccentric worm wheel rotatably mounted in the second member and engaging the rail, a worm rotatably mounted in the rail and meshing with the worm wheel so that rotation of the worm entails an angular displacement of the worm wheel and a corresponding adjustment of the rail with respect to the second member (as a result of eccentricity of the worm wheel), and a second rail or analogous means for transmitting the adjustments of the rail to the reciprocable member.

The worm wheel is preferably adjacent to an end portion of the rail, and the axis of the worm wheel is preferably at least substantially normal to the longitudinal direction of the rail. When the device serves to guide a drawer, e.g., in a cabinet with one or more drawers, the axis of the worm is normally horizontal or nearly horizontal, and the rail includes a section (e.g., a top flange which forms part of a rail having a U-shaped cross-sectional configuration) which overlies and is engaged by the worm wheel. The axis of the worm is at least substantially parallel to the longitudinal direction of the rail. The rail preferably comprises or carries bearing means for the worm. If the reciprocable member is a drawer, the worm is preferably accessible in the open or partly open position of the drawer.

The novel features which are considered as characteristic of the invention are set forth in particular in the appended claims. The improved device itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
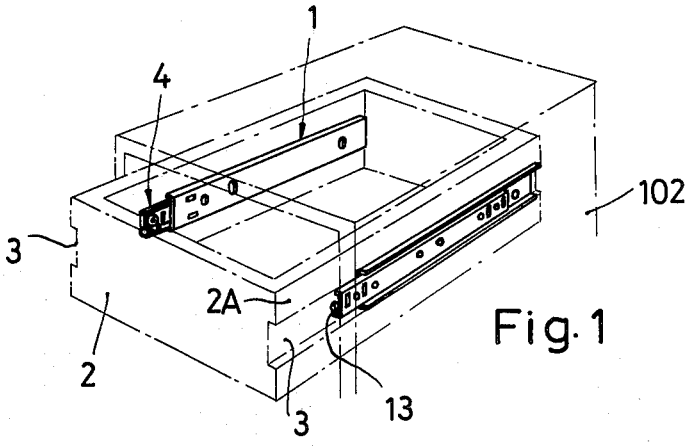
FIG. 1 is a fragmentary perspective view of a portion of a piece of furniture and of a drawer therein, the stationary member of the piece of furniture and the drawer being shown by phantom lines and the improved device which guides the drawer being shown by solid lines.
Figure 2:
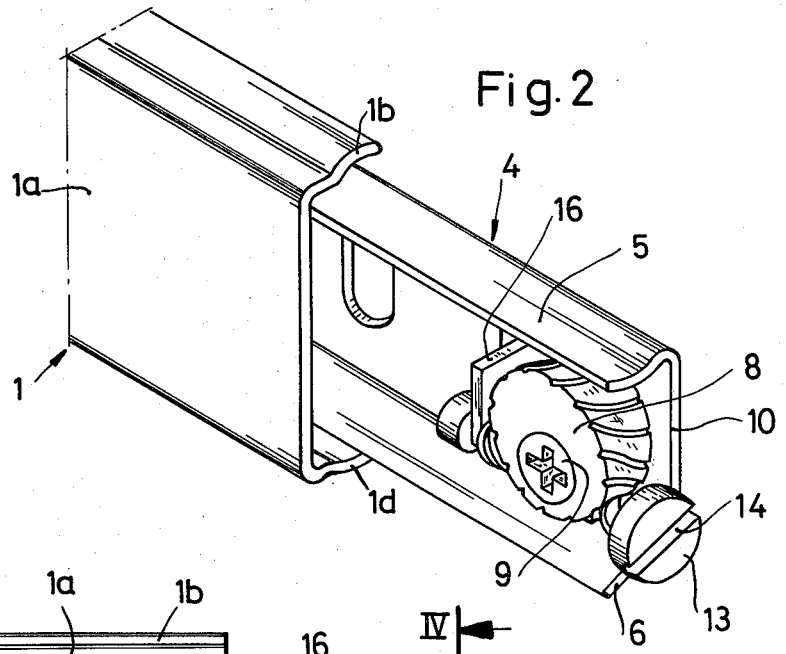
FIG. 2 is an enlarged perspective view of a portion of one half of the guiding device, the component parts of the illustrated structure being shown in the positions they assume when the drawer is in partly open position.

FIG. 1 shows a piece of furniture which includes a stationary member or housing 102 and one or more reciprocable drawers 2. The member 102 may form part of a piece of furniture which constitutes a cabinet with several superimposed drawers. The front panel of the drawer 2 has been omitted for the sake of clarity so as to show portions of two elongated grooves or channels 3 which are machined into the vertical side faces 2*a* of the drawer to receive the webs 1*a* and portions of the flanges 1*b*, 1*d* of two elongated horizontal rails 1 which are separably but fixedly secured to the drawer 2 by screws or other suitable fastener means. Each of the rails 1 has a U-shaped cross-sectional configuration, and the flanges 1*b*, 1*d* of each rail 1 are outwardly adjacent to the upper and lower sections or flanges 5, 6 of two complementary U-shaped rails 4 which are adjustably secured to the stationary member 102. The flanges 1*b*, 1*d* and the flanges 5, 6 have a concavo-convex cross-sectional outline; the outer sides of the flanges 5, 6 and the inner sides of the flanges 1*b*, 1*d* are concave so that these flanges define elongated tracks for rows of spheres 7 or other suitable friction-reducing rolling elements which are preferably confined in suitable cages 7A. The rolling elements 7 ensure that the drawer 2 can be moved to and from the closed position (not specifically shown in the drawing) with a minimum of effort. These rolling elements and their cages 7*a* are shown only in FIG. 4.

The front end portions of the rails 4 (i.e., the left-hand end portions, as viewed in FIG. 1) are accessible when the drawer 2 is moved from its closed position because the front panel of the drawer is then remote from the front side of the stationary member 102. Such front end portions of the rails 4 are formed with vertical or nearly vertical slots 10A (see FIG. 4) for the shanks of horizontal screws 9 or analogous fasteners which rotatably secure to the stationary member 102 a pair of eccentric worm wheels 8, each of which has a concave circumferential groove 11 for the convex underside of the respective upper flange 5. Thus, the front end portions of the rails 4 rest on the respective worm wheels 8 which are secured to the stationary member 102 because the shanks of the respective fasteners 9 extend through the corresponding slots 10A in the vertical webs 10 of the associated rails 4. It will be noted that each worm wheel 8 is disposed in the space between the corresponding flanges 5, 6 but is remote from the lower flange 6. Owing to its eccentric mounting on the respective fastener 9 which defines a horizontal axis of rotation extending at right angles to the direction of reciprocatory movement of the drawer 2 along the path defined by the rails 1 and 4, each worm wheel 8 can adjust or effect an adjustment of the respective rail 4 when rotated in a direction toward the angular position of FIG. 3. On the other hand, the front end portions of the rails 4 descend, e.g., by gravity, when the worm wheels 8 are rotated in a direction to move their axes downwardly. The rails 1 transmit the adjustment of the front end portions of the rails 4 to the drawer 2 so that the front portion of the drawer can be raised or lowered, depending on the requirements, for example, to insure that, in the closed position of the drawer, the front side of its front panel is flush with the front side of the stationary member 102.

Figure 3:
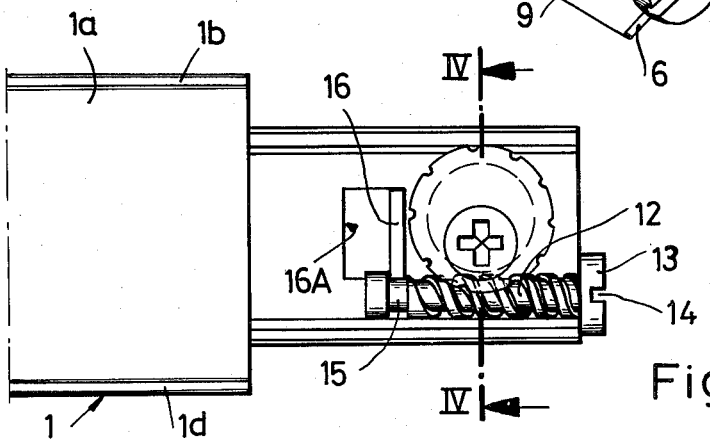
FIG. 3 is a front elevational view as seen from the left-hand side of FIG. 2.

The worm wheels 8 are rotatable by discrete worms 12 which are elongated and whose axes are parallel or substantially parallel to the corresponding rails 4. The worms 12 are rotatably mounted in bearings 16 which are provided therefor in the respective rails 4. As best shown in FIG. 3, that end portion of the worm 12 which is remote from the front end portion of the respective rail 4 has a circumferential groove 15 for a simple bearing 16 including a projection or lug which, in the illustrated embodiment, is an integral part of the respective rail 4. To this end, the web 10 of the rail 4 is formed with a U-shaped slit 16A and the material within the slit is bent into the space between the flanges 5, 6 to constitute the aforementioned projection or lug 16. The other or front end portion 13 of the worm 12 constitutes an enlarged head whose front end face has a diametrically extending slot 14 for the working end of a screwdriver, for a piece of a coin or for another rudimentary tool which can be used to rotate the worm 12 and to thus change the angular position of the associated worm wheel 8. The lug 16 holds the worm 12 against axial movement relative to the respective rail 4.

The outline of the surface surrounding the circumferential groove 11 of each worm wheel 8 preferably conforms to the concavity of the underside of the respective flange 5. This insures that the level of the front end portions of each pair of complementary rails 1, 4 can be adjusted with a high degree of precision.

FIG. 1 shows that the rails 1 need not extend all the way to the front side of the drawer 2. FIG. 1 further shows that the devices at both sides of the drawer can be fully concealed by the simple expedient of closing the drawer. On the other hand, the heads 13 of both worms 12 are immediately and readily accessible as soon as the drawer 2 is moved from its closed position. As the operator rotates the one and/or the other worm 12, the angular position of the corresponding worm wheel 8 changes and this causes the front end of the corresponding rail 4 to move the front portion of the drawer 2 up or down. Such adjustment is often desirable or necessary in order to enhance the appearance of the piece of furniture, to ensure that the drawer 2 is readily movable to and from its closed or open position and/or to ensure that the drawer does not open at an inopportune time. As mentioned above, the provision of circumferential grooves 11 and of complementary undersides of the flanges 5 renders it possible to achieve a desirable form fit between the parts 4 and 8 and to thus allow for highly accurate adjustments of the level of the drawer. Moreover, such design is less likely to allow wobbling of drawer with respect to the stationary member 102.

Figure 4:
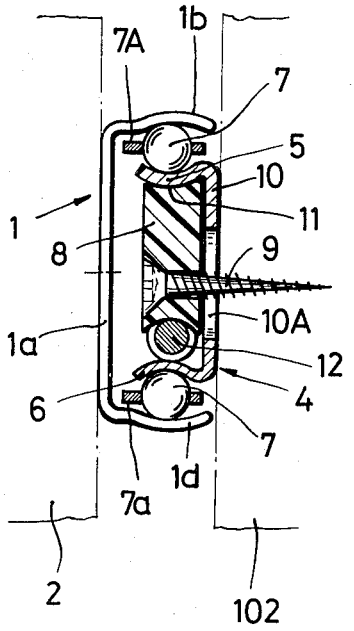
FIG. 4 is a transverse vertical sectional view as seen in the direction of arrows from the line IV—IV of FIG. 3.

FIG. 4 shows that the apex of the convex upper side of the lower flange 6 of the illustrated rail 4 is located to the left of the axis of the worm 12. Thus, the worm 12 is mounted in the space between the flanges 5 and 6 in such a way that it is closely adjacent to the web 10 and that its axis is located between the apex of the upper side of the flange 6 and the inner side of the web 10. This reduces the likelihood of accidental movement of the front end portion of the worm 12 from an optimum position with respect to the rail 4.

By adjusting the front end portion of a single rail 4 and/or by adjusting the front end portion of one rail 4 to an extent which is different from the extent of adjustment of the front portion of the other rail 4, once can change the level as well as the inclination of the front portion of the drawer 2.

The improved device is susceptible of many modifications without departing from the spirit of the invention. For example, the rails 4 can be replaced with rails having an outline which deviates from a U-shaped configuration. Thus, the upper flanges 5 of the rails 4 can be omitted or replaced by otherwise configurated rail portions (e.g., by portions which extend toward the drawer 2 in cantilever fashion) whose front end portions are engaged by the eccentrically mounted worm wheels to allow for changes in the level of the front end portions of such rails as well as of the complementary rails which are affixed to the reciprocable member.

It is further possible to employ different types of bearings for the worms 12 and/or different types of means for rotatably supporting the eccentric worm wheels 8. All such modifications will be readily comprehended by men skilled in this art without resort to additional illustrations.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. A device for guiding a reciprocable member along an elongated path to and from an end position with respect to a second member, particularly for guiding a drawer with respect to a stationary constituent of a piece of furniture, comprising a pair of rails extending in substantial parallelism with each other and said path at the opposite sides of the reciprocable member and having end portions adjustably mounted in said second member, said end portions being accessible upon movement of said reciprocable member from said end position; first and second eccentric worm wheels rotatably mounted in said second member at the opposite sides of said reciprocable member and engaging with the end portions of the respective rails; first and second worms rotatably mounted in the end portions of the respective rails and meshing with the corresponding worm wheels so that rotation of each worm entails an angular displacement of the respective worm wheel and a corresponding adjustment of the respective rail relative to said second member, said worm wheels being rotatable about axes which are substantially normal to said path and said worms being substantially parallel to the respective rails and being accessible for rotation upon movement of said reciprocable member from said end position; and means for transmitting the adjustments of said rails to said reciprocable member.

2. The device of claim 1, wherein the axes of said worm wheels are substantially horizontal and each of said rails includes a section which overlies the respective worm wheel in the region of the end portion of the respective rail, said sections being in engagement with the corresponding worm wheels.

3. The device of claim 1, further comprising bearing means provided on said rails and rotatably supporting the respective worms.

4. The device of claim 1, wherein said reciprocable member is a drawer which is movable to and from a closed position constituting said end position and said worms are accessible to rotate the respective worm wheels when said drawer is out of said closed position.

5. The device of claim 1, wherein said transmitting means comprises second rails secured to said reciprocable member in substantial parallelism with said path, each of said second rails being adjacent to one of said first mentioned rails and further comprising friction reducing rolling elements interposed between said first mentioned rails and the respective second rails.

6. The device of claim 5, wherein each of said first mentioned rails has a top flange which rests on the respective worm wheel.

7. The device of claim 1, further comprising bearing means provided on said rails for the respective worms, said worms having circumferential grooves and said bearing means comprising projections extending into the respective grooves.

8. The device of claim 7, wherein said grooves of said worms are remote from the end portions of the respective rails.

9. The device of claim 8, wherein each of said worms has an end portion remote from the respective groove and being accessible in the region of the end portion of the respective rail, said end portions of said worms being arranged for rotation by a tool.

10. The device of claim 9, wherein said end portions of said worms have diametrically extending slots.

11. The device of claim 7, wherein said projections are lugs which are integral with the respective rails.

12. The device of claim 1, wherein said transmitting means comprises second rails extending in substantial parallelism with said path, said first mentioned and the respective second rails having neighboring flanges defining concave tracks and further comprising antifriction rolling elements between said flanges.

13. The device of claim 1, wherein each of said worms has a circumferential groove and each of said rails includes a portion which extends into the respective groove.

14. The device of claim 1, wherein each of said rails includes a lower flange having a convex upper side and a web integral with and extending upwardly from said flange, said convex side having an apex and the corresponding worm being adjacent to said web and having an axis located between said apex and said web.

15. The device of claim 14, wherein said flanges are substantially horizontal and said webs are located in substantially vertical planes, said axes being parallel to said rails.

* * * * *